US010898913B2

(12) United States Patent
Molz et al.

(10) Patent No.: US 10,898,913 B2
(45) Date of Patent: Jan. 26, 2021

(54) LONG-LIFE PLASMA NOZZLE WITH LINER

(71) Applicant: OERLIKON METCO (US) INC., Westbury, NY (US)

(72) Inventors: Ronald J. Molz, Ossining, NY (US); Dave Hawley, Westbury, NY (US)

(73) Assignee: OERLIKON METCO (US) INC., Westbury, NY (US)

( * ) Notice: Subject to any disclaimer, the term of this patent is extended or adjusted under 35 U.S.C. 154(b) by 471 days.

(21) Appl. No.: 15/038,330

(22) PCT Filed: Dec. 19, 2013

(86) PCT No.: PCT/US2013/076631

§ 371 (c)(1),
(2) Date: May 20, 2016

(87) PCT Pub. No.: WO2015/094295

PCT Pub. Date: Jun. 25, 2015

(65) Prior Publication Data

US 2016/0296955 A1 Oct. 13, 2016

(51) Int. Cl.

| | |
|---|---|
| ***B05B 7/22*** | (2006.01) |
| ***H05H 1/34*** | (2006.01) |
| ***H05H 1/42*** | (2006.01) |
| ***C23C 4/12*** | (2016.01) |

(52) U.S. Cl.

CPC ..... *B05B 7/22* (2013.01); *C23C 4/12* (2013.01); *H05H 1/34* (2013.01); *H05H 1/42* (2013.01); *H05H 2001/3457* (2013.01); *H05H 2001/3478* (2013.01)

(58) Field of Classification Search
None
See application file for complete search history.

(56) References Cited

U.S. PATENT DOCUMENTS

| | | | | |
|---|---|---|---|---|
| 4,140,892 | A | 2/1979 | Muller | |
| 4,430,546 | A | 2/1984 | Irons | |
| 4,594,496 | A | 6/1986 | Bebber | |
| 5,004,888 | A * | 4/1991 | Wolf | H05H 1/34 219/119 |

(Continued)

FOREIGN PATENT DOCUMENTS

| | | |
|---|---|---|
| EP | 1 531 652 | 9/2004 |
| JP | 63-154272 | 6/1988 |

(Continued)

OTHER PUBLICATIONS

PCT Search Report and Written Opinion issued in International Application No. PCT/US13/76631.

(Continued)

*Primary Examiner* — Shamim Ahmed
*Assistant Examiner* — Bradford M Gates
(74) *Attorney, Agent, or Firm* — Greenblum & Bernstein, P.LC.

(57) ABSTRACT

A plasma nozzle (120) having a nozzle body and a liner material (123) arranged within the nozzle body. The liner material (123) has a higher melting temperature than the nozzle body and includes one of a Tungsten alloy having a cross-sectional thickness (C) significantly greater than 0.25 mm, Molybdenum, Silver and Iridium.

26 Claims, 9 Drawing Sheets

(56) References Cited

U.S. PATENT DOCUMENTS

| | | | | |
|---|---|---|---|---|
| 5,767,478 | A | 6/1998 | Walters | |
| 6,963,045 | B2 | 11/2005 | Zapletal | |
| 7,342,197 | B2 | 3/2008 | Hanus | |
| 7,659,488 | B2 | 2/2010 | Cook | |
| 8,253,058 | B2 | 8/2012 | Zehav | |
| 8,596,040 | B2 | 12/2013 | Chasman | |
| 2005/0103752 | A1 | 5/2005 | Zapletal | |
| 2006/0289396 | A1* | 12/2006 | Duan | H05H 1/34 219/121.5 |
| 2008/0220558 | A1* | 9/2008 | Zehavi | H01L 31/182 438/57 |
| 2015/0152541 | A1* | 6/2015 | Baldwin | B05B 7/226 239/132 |
| 2015/0319833 | A1 | 11/2015 | Molz | |
| 2015/0329953 | A1 | 11/2015 | Molz | |

FOREIGN PATENT DOCUMENTS

| | | |
|---|---|---|
| JP | 6-66876 | 9/1994 |
| JP | 2016-514200 | 5/2016 |
| WO | 98/38841 | 9/1998 |
| WO | 2014/120357 | 8/2014 |
| WO | 2014/120358 | 8/2014 |

OTHER PUBLICATIONS

EPO Search Report and Written Opinion issued in Application No. 13899460.3.

JPO Office Action dated Sep. 26, 2018 issued in Application No. 2016-536731.

JPO Office Action (with English translation) dated May 28, 2019 issued in Application No. 2018-097332 (11 pages).

* cited by examiner

Fig. 2
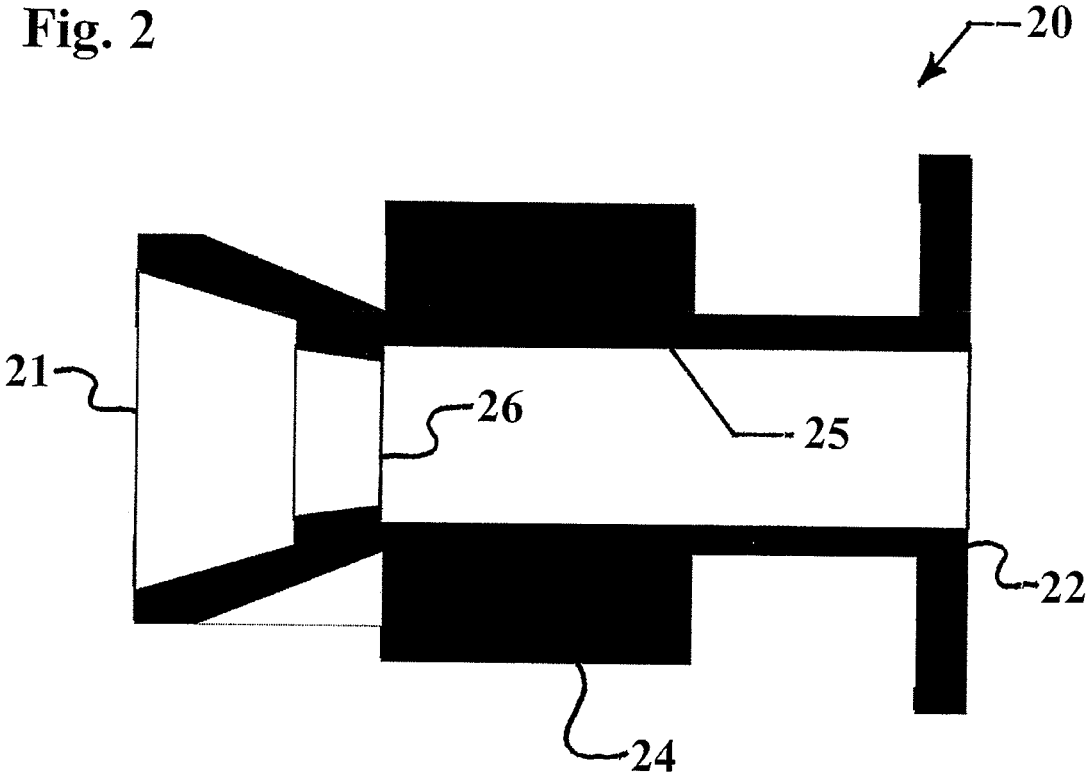
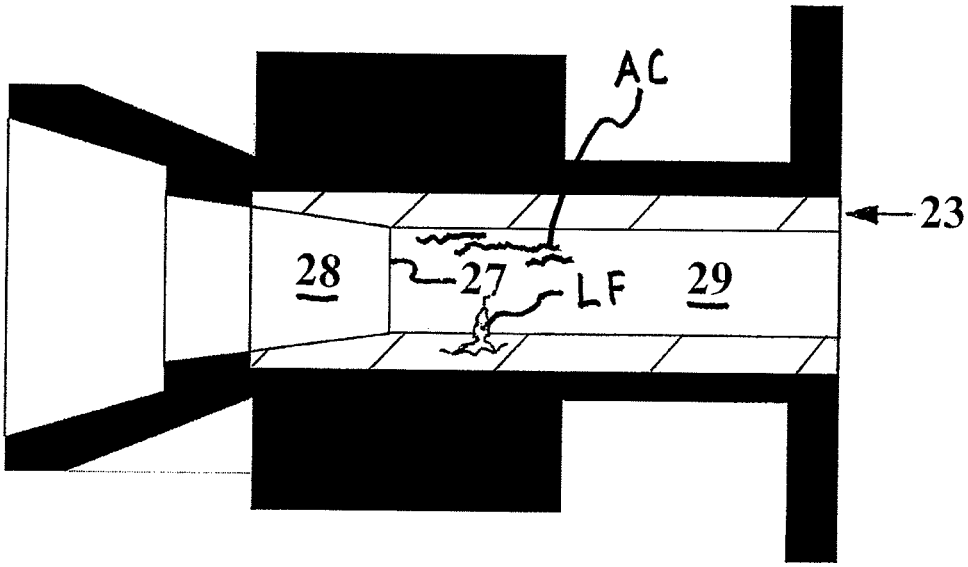
Fig. 3

LONG-LIFE PLASMA NOZZLE WITH LINER

CROSS-REFERENCE TO RELATED APPLICATIONS

The present application is a U.S. National Stage of International Patent Application No. PCT/US2013/076631 filed Dec. 19, 2013 which published as WO 2015/094295 on Jun. 25, 2015.

STATEMENT REGARDING FEDERALLY SPONSORED RESEARCH OR DEVELOPMENT

Not applicable.

REFERENCE TO A COMPACT DISK APPENDIX

Not applicable.

BACKGROUND OF THE INVENTION

Historically, thermal spray plasma guns use Tungsten (W) doped with preferably either Thorium or Lanthanum as cathode emitters due to the desired thermionic emission properties. The use of these same Tungsten materials has also been used in anodes in order to also improve their hardware life. This material works well in both cathodes and anodes because Tungsten has a high melting point as well as a thermal conductivity about one third that of copper. The use of doped Tungsten in nozzles improves hardware life but has disadvantages in that the material can also fracture, and in the case of Thoriated Tungsten, becomes a hazardous material problem in the waste stream because it is radioactive.

Currently, plasma gun nozzle anodes are typically of two types. Either they are made with a doped Tungsten lining or they are made of pure copper. Recent studies and extensive testing indicate that Tungsten always fractures when used as a lining in plasma gun anodes and this fracturing can lead to substantially reduced hardware life. Cracks act to attract the arc. Thus, in most conventional plasma guns the arc needs to be kept in constant motion to prevent the arc from destroying the surface material at the location of arc attachment. Once cracking occurs the cracks attract the arc and this promotes elevated rates of surface decay due to the thermal loading, and can even cause catastrophic failure of the Tungsten lining if the arc were to stop moving completely and the thermal stresses become excessive. The more severe or pronounced the cracks the increased chance that the arc will linger on the cracks.

Plating of plasma gun anodes with Tungsten and even Tungsten carbide has also been attempted, however, with only limited success. The thickness of the plated layer, e.g., between 1 and 10 thousands of an inch, is insufficient to protect the underlying copper from melting even when the plating is Tungsten. In the case of Tungsten carbide plating, the electrical and thermal conductivity properties are not suitable.

The performance of doped Tungsten is better than copper, but considerable room for improvement can be obtained in finding a material that is better suited with the following properties:

1. Is more ductile and fracture tolerant than Tungsten, specifically under high thermal loading and high temperature gradients.
2. Possesses similar high melting point or as close as possible.

3. Possesses a high enough thermal conductivity to compensate for a lower melting point than Tungsten.

As a result of experience gained in the art of the type described above, nozzles used in thermal spray guns are typically lined with a liner material or sleeve in order to promote longer hardware life rather than being made entirely of a pure material such as copper. As noted above, a common liner material is Tungsten. Historically, however, a wall thickness of the Tungsten liner was set arbitrarily, i.e., based upon considerations such as using a common or standard diameter Tungsten blank for a complete family of nozzle bore diameters, with the main concern being ease of manufacture. Thus, there was no attempt to study or optimize characteristics of the lining material such as lining wall thickness. The typical Tungsten material used for the lining material was often chosen to be the same as that used for the plasma gun cathode (i.e., the cathode electrode). This choice was also made for reasons of ease of manufacture since it only requires the sourcing of a single material.

Although Tungsten lined plasma gun nozzles have increased life, when compared to nozzles without such lining materials, i.e., pure copper nozzles, they are nevertheless subject to cracking and even failure. The cracking is believed result from high thermal localized stresses occurring within the Tungsten and worsens over time as the plasma gun is operated. The cracking typically occurs in an area or zone known as the arc attaching zone, as will be described below with reference to FIG. 3. This is a zone where a plasma arc makes electrical contact with an inside surface of the lining material after being discharged from a tip area of the cathode. It is this zone of the Tungsten lining that is believed to experience the most thermal stress.

In most cases the cracks align axially with the gun (or Tungsten lining) bore. These axial cracks (see ref. AC in FIG. 3) can have an effect on the overall hardware life as well as on the arc behavior. In some cases, however, cracks can form that are instead oriented circumferentially within the plasma nozzle bore (see ref. LF in FIG. 3). These cracks are more problematic than the axial cracks, and have been associated with the catastrophic failure of the Tungsten lining; in which portions of the lining actually separate from the lining material, enter the plasma stream and can even be introduced into (or contaminate) the coating of the substrate being coated by the plasma spray gun. At the very least, the presence of these circumferential cracks have a large adverse effect on plasma arc stability—resulting in an even greater effect than that produced by the axial cracks. To prevent this, nozzles are typically replaced on a regular basis; which adds to manufacturing costs of the coating.

Since there is no way to predict the potential for the more problematic circumferential cracks and the eventual catastrophic failure of the lining material, personnel operating plasma guns equipped with such nozzles must be extra diligent in checking for signs of potential cracking—which can sometimes be detected by monitoring plasma gun voltage behavior. Based on such signs, the operator will typically stop the coating process and replace the nozzle with a new nozzle. This unpredictability has, at the very least, the effect of reducing the operating lifetime advantage of Tungsten lined nozzles.

Thus, there remains a need to improve the consistency, predictability and operating life of plasma gun hardware as well as the overall gun performance. One way to do this is to reduce the potential for cracking within the nozzle lining or nozzle bore.

What is additionally and/or alternatively needed in the art is a nozzle anode lining material that has improved life over that currently achieved and that overcomes one or more disadvantages noted above, such as being more environmentally safer as well as fracture tolerant in high temperature applications.

As the information noted above is also believed to be applicable to the art of plasma rocket nozzles or thrusters, what is needed in the art of plasma rocket nozzles or thrusters is a rocket nozzle or thruster that has comparable improved life and benefits.

SUMMARY OF THE INVENTION

In accordance with one non-limiting embodiment, there is provided a thermal spray gun comprising a nozzle body and a liner material arranged within the nozzle body. The liner material has a higher melting temperature than the nozzle body and comprises one of a Tungsten alloy having a cross-sectional thickness significantly greater than 0.25 mm (about 0.010 inches), Molybdenum, Silver and Iridium. Significantly greater means, in this context, more than about 25% greater than a typical maximum plating thickness of 0.25 mm. An acceptable cross-sectional thickness is at least twice a typical plating thickness or greater than 0.5 mm thick.

In embodiments, at least one of: a wall thickness of the liner material has a value determined in relation to or that corresponds to a wall thickness of the nozzle body and a ratio of a total wall thickness of a portion of a nozzle to that of a wall thickness of the liner material has a value determined in relation to or that corresponds to the wall thickness of liner material.

In embodiments, the ratio is equal to or greater than about 3.5:1. In embodiments, the ratio is at least one of: between about 3.5:1 and about 7:1; between about 4.1:1 and about 6:1; and about 5:1.

In embodiments, the liner material is Tungsten alloy. In embodiments, the liner material is Molybdenum. In embodiments, the liner material is one of Silver and Iridium.

In embodiments, the nozzle body is made of a copper material.

In embodiments, the wall thickness of the nozzle body and the liner material are each measured in an axial area of an arc attachment zone.

In embodiments, in normal operation, the liner material experiences less or comparable thermal stress in an area of an arc attachment zone than in an area downstream of the arc attachment zone.

In embodiments, the wall thickness of the liner material is at least one of between about 0.25 mm and about 1.25 mm, between about 0.50 mm and about 1.0 mm, and between about 0.75 mm and about 1.0 mm.

In embodiments, the gun further comprises a cathode and an anode body through which cooling fluid circulates.

In embodiments, there is provided a plasma nozzle comprising a nozzle body and a liner material arranged within the nozzle body. A material of the nozzle body has a lower melting temperature than that of the liner material and comprises one of: a Tungsten alloy having a cross-sectional thickness one of significantly greater than 0.25 mm and greater than 0.5 mm; Molybdenum; Silver; and Iridium.

In embodiments, the plasma nozzle is a plasma rocket nozzle. In embodiments, the plasma nozzle is a plasma nozzle of a thermo or thermal spray gun.

In embodiments, at least one of a wall thickness of the liner material has a value determined in relation to a wall thickness of the nozzle body and a ratio of a total wall thickness of a portion of a nozzle to that of a wall thickness of the liner material has a value determined in relation to or that corresponds to the wall thickness of liner material.

In embodiments, the ratio is equal to or greater than about 3.5:1. In embodiments, the nozzle is a replaceable nozzle. In embodiments, the ratio is at least one of: between about 3.5:1 and about 7:1; between about 4.1:1 and about 6:1; and about 5:1.

In embodiments, the liner material is Tungsten alloy. In embodiments, the liner material is Molybdenum. In embodiments, the wall thickness of the liner material is at least one of: between about 0.25 mm and about 1.25 mm; between about 0.50 mm and about 1.0 mm; and between about 0.75 mm and about 1.0 mm.

In embodiments, there is provided a method of making the nozzle of any of the types described above, wherein the method comprises forming the liner material with a wall thickness whose value takes into account at least one of: a wall thickness of a portion of the nozzle body; and a ratio of a total wall thickness of a portion of the nozzle to that of a wall thickness of a portion of the liner material.

In embodiments, there is provided a method of coating a substrate using a thermo spray gun, wherein the method comprises installing the nozzle of claim 13 on a thermo spray gun and spraying a coating material onto a substrate.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted drawings by way of a non-limiting example embodiment of the present invention, and wherein:

FIG. 2 shows a schematic nozzle used in the plasma gun of FIG. 1 and with the lining material removed for purposes of illustration;

FIG. 3 shows the nozzle of FIG. 2 with a Tungsten lining material disposed therein. Also shown are examples of both axial cracks and a circumferential lining failure crack formed in the lining as can occur after a significant amount of use in a plasma gun;

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
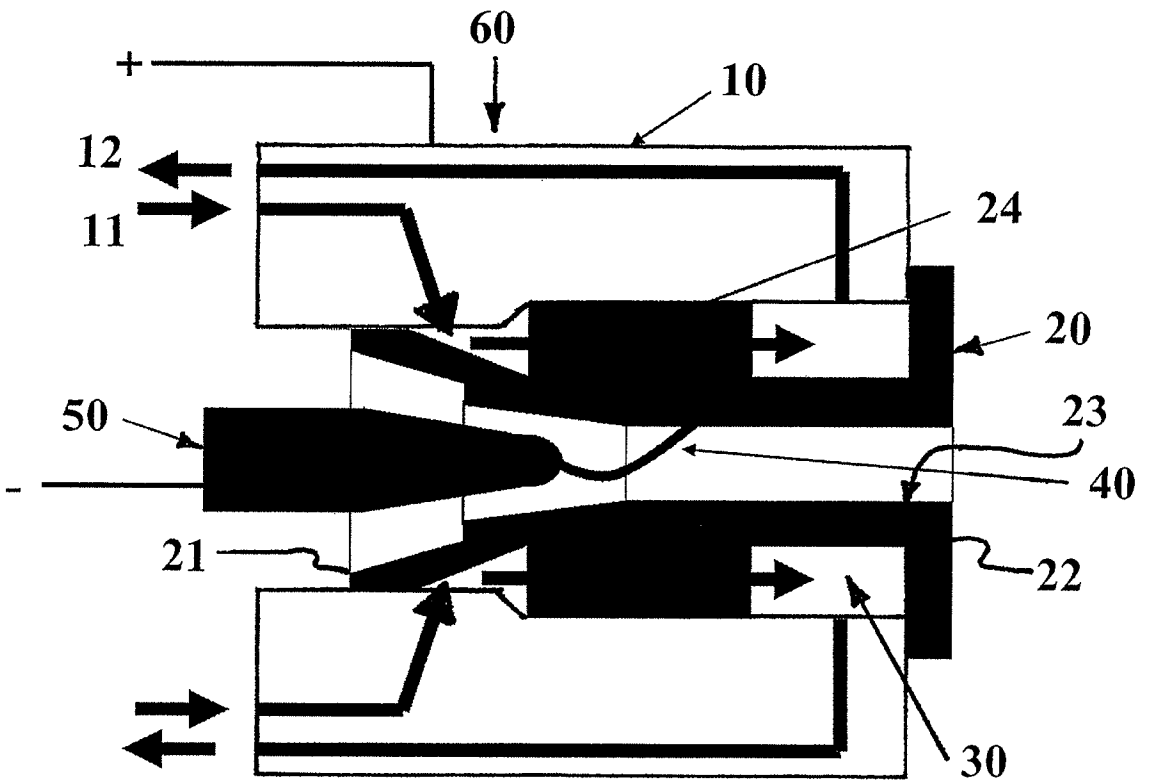
FIG. 1 shows a side cross-section schematic view of a thermo spray gun having a nozzle with a Tungsten lining material.
Figure 5:
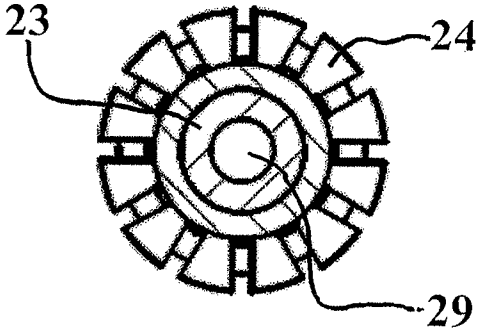
FIG. 5 shows a cross-section view of Section A-A in FIG. 4.

Plasma guns used to spray coatings, like the one encompassed by embodiments of the invention, have a cathode and an anode. The anode can also be referred to as a nozzle in these plasma guns as it also serves a fluid dynamic function in addition to functioning as the positive side of the electrical circuit forming the plasma arc. The nozzle is fluid cooled, i.e., with water, to prevent melting and is typically constructed of a copper material as it possesses a high thermal conductivity. Nozzles having a lining of Tungsten located in an area of the inside bore facing the plasma arc are produced to provide improved/longer hardware life over those just made of copper. Tungsten has a relatively high thermal conductivity as well as a very high melting temperature. FIG. 1, which will be described in more detail below, schematically shows a cross section of a plasma gun having a water-cooled nozzle which can be used in accordance with the invention.

Tungsten lined plasma nozzles use Tungsten linings that are typically 1 or more mm in thickness. In some cases the Tungsten may be over 3 mm in thickness. The lining material sleeve is often made of Thoriated Tungsten, which is the same composition used in plasma gun cathodes or electrodes. Both the composition and overall diameter of the Tungsten used to fabricate the nozzle, however, is typically chosen as a matter of convenience. In many cases, the outside diameter of the Tungsten liner used is held constant while its bore diameter varies according to a particular application of gun type. No consideration in the design or configuration of these plasma gun nozzles is given to selecting an optimal wall thickness for the Tungsten lining.

In addition to the thickness of the Tungsten lining, the ratio of the wall thickness of the lining to the overall wall thickness of the nozzle body from the closest distance to the cooling water channel is typically around 1:2. This means the wall thickness of the Tungsten liner is about as thick as the wall thickness of the copper body.

As will be shown below with reference to FIG. 6, it has been discovered that having a relatively thick (wall thickness) Tungsten lining and a relatively high Tungsten to copper thickness ratio can result in high concentrations of internal stress being formed in the Tungsten lining during operation. This can result in the eventual failure of the Tungsten liner as mentioned above. Embodiments of the invention, which will be described with reference to FIGS. 1-5 and 7-10, takes into account these considerations.

In a similar vein, the inventors have undertaken further research on material properties of nozzle material and turned up a number of potential materials that can be used to make the nozzle. In the case of pure metals, it has been discovered, as will be shown in detail below, that Silver, Iridium, and Molybdenum have desirable properties. However, both Silver and Iridium are considered as being too expensive for practical use while Molybdenum is considered affordable. Tungsten alloys containing small amounts of iron or nickel were also determine to have acceptable properties. Alloying of metals almost always reduces thermal and electrical conductivity, but in cases where only small amounts of one or two metals is used, bulk properties can approach 90% or higher of the primary metal in the alloy. This is the case with Tungsten alloys as well.

Figure 11:
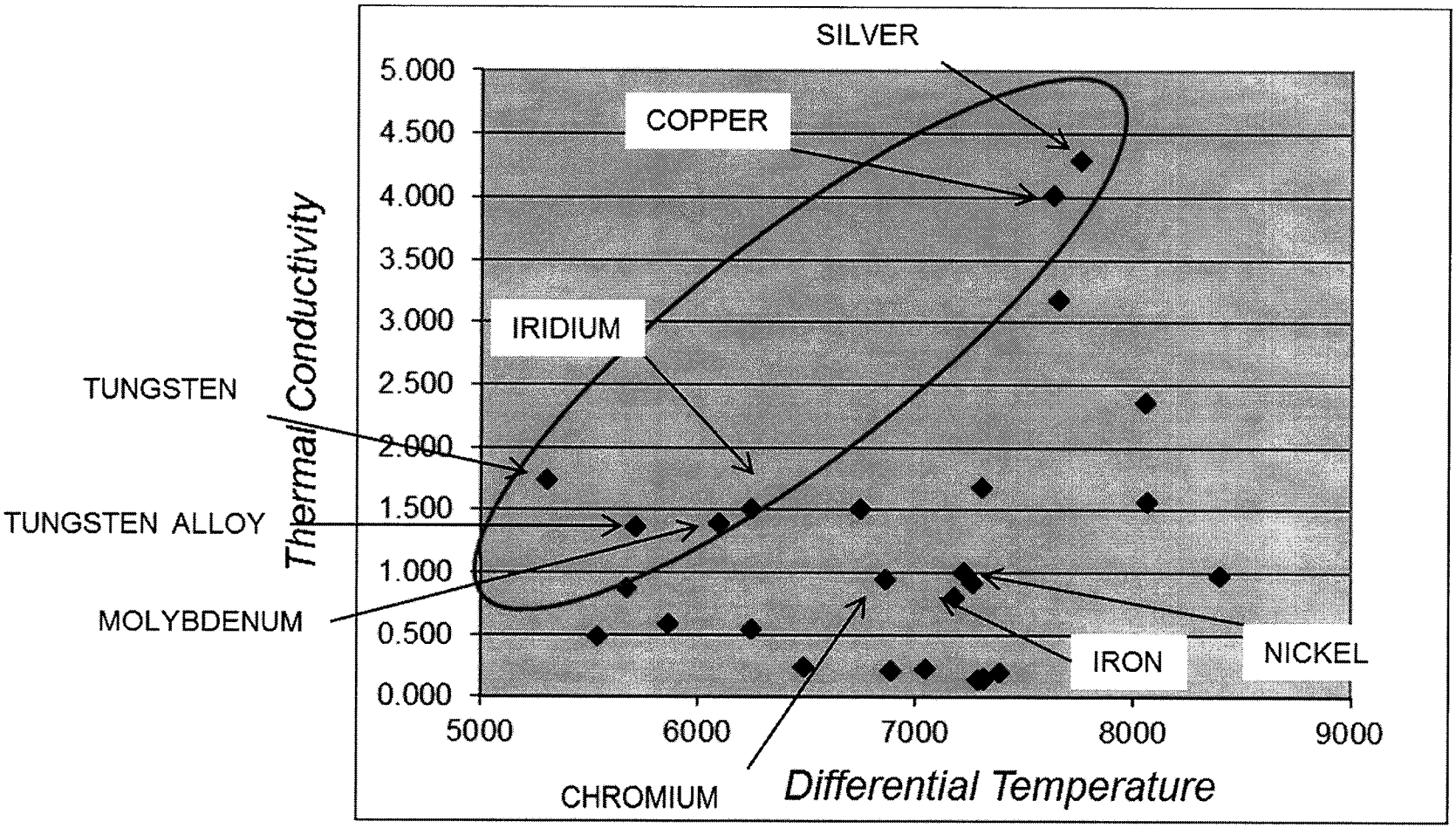
FIG. 11 shows a chart describing differential temperature versus thermal conductivity.
Figure 12:
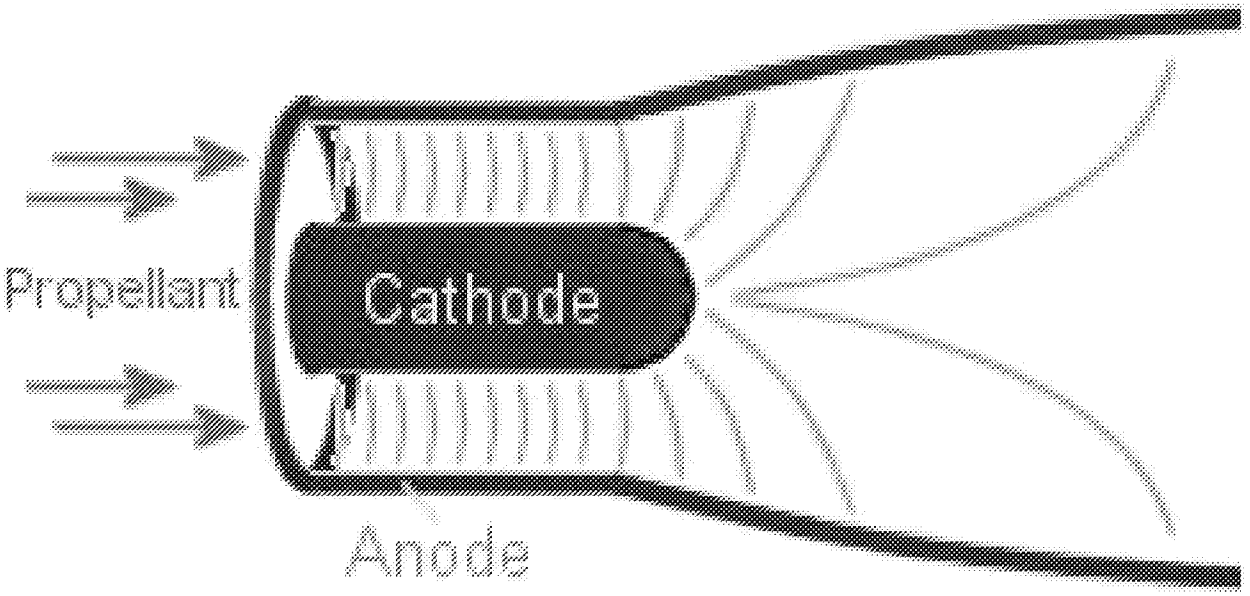
FIG. 12 shows an exemplary rocket nozzle having a lining material in accordance with the invention.

A methodology of selecting materials involves graphing the differential temperature versus the thermal conductivity of each possible material in order to select materials that are likely to withstand direct contact with a plasma arc. The differential temperature is preferably the difference between the melting point and average plasma gas temperature (9000 K) and at the least an inverse of the melting temperature. Using this methodology results in desirable materials being located on the upper left side of the chart shown in FIG. 11 because, in principle, the upper left corner of the chart would provide the best results. But, as can be seen in FIG. 11, no materials possessing the desired properties can be found there. However, materials located within the encircled area of FIG. 11 represent property bounds considered ideal for use as an anode lining best suited to withstand the rigors of a plasma arc.

Referring again to FIG. 11, it can be discerned that the pure metals described previously (Molybdenum, Iridium, Tungsten, Copper, and Silver) fall within the encircled area with Tungsten being the farthest to the left. Molybdenum and Iridium are to the right near the edge of the desired area. Both of these metals are more ductile and thus considered less susceptible to thermal shock. Copper and Silver are located along the right side of the encircled area. These two materials are also ductile and, as noted above, Copper has been used in plasma guns since their inception without any issues with thermal shock, cracking, etc.

Ideal Tungsten alloys are shown on FIG. 11 to be located between Tungsten and Molybdenum. The properties of these alloys were estimated from other known properties for these alloys. The preferred alloy of Tungsten contains about 2.1% (weight percent) of Nickel and about 0.9% (weight percent) Iron. Other concentrations of Nickel and copper are possible with higher amounts having lower melting points and thermal conductivity, but with higher ductility while lower amounts have higher melting points and thermal conductivity, but with lower ductility.

Other possible alloying elements with Tungsten include Osmium, Rhodium, Cobalt, and Chromium. These metals possess high enough melting and high thermal conductivity so as to fall within the encircled area on FIG. 11.

Reference is now made to FIGS. 2 and 3. In accordance with embodiments of the invention, plasma gun nozzles were made using linings made of commercial grade Molybdenum, and a preferred alloy of Tungsten (2.1% Ni and 0.9% Fe). These were tested and compared to conventional Tungsten lined nozzles (see FIG. 3) and a copper only nozzle (see FIG. 2). The lined nozzle of FIG. 3 was made using the different materials mentioned above (Molybdenum, High Tungsten Alloy, and Tungsten). These nozzles were then subjected to operation in a plasma gun at an extreme high energy parameter known to result in poor hardware performance. The results are tabulated in table 1 noted below.

TABLE 1

| Liner Material | Average Life | Cracking | Melting | Failure mode |
|---|---|---|---|---|
| Thoriated Tungsten | 14.32 hours | Yes | No | Severe cracking |
| Tungsten Alloy | 5.28 hours | No | Yes | Melting |
| Molybdenum | 10.76 hours | No | Yes | Voltage Decay |
| Copper | 4.08 hours | No | Yes | Severe melting |
| Thin Molybdenum | 14.33 hours | No | No | Voltage Decay |

As can be seen from Table 1, conventional nozzles using a Thoriated Tungsten liner (per FIG. 3) lasted an average of 14.32 hours before severe cracking resulted in rapid voltage decay and/or failure of the Tungsten lining. There was little evidence of melting except in one case where the arc attached to a severe crack. The range of hardware life varied from about 10 hours to 17 depending mostly on the severity of cracking.

Nozzles fabricated in accordance with an embodiment of the invention and using a preferred alloy of Tungsten (2.1% Ni and 0.9% Fe) as the liner material (again resembling FIG. 3) lasted an average of 5.28 hours before melting resulted in rapid voltage decay. There were no cracks or signs of the Tungsten alloy liner failing. The range of hardware life varied from about 4 to 6 hours and depending entirely upon the extent of melting. Although not lasting as long as the Thoriated Tungsten liner nozzle, the Tungsten alloy liner nozzle offers much improved performance compared to a copper only nozzle as will be described below.

Next in Table 1 are listed nozzles fabricated using Molybdenum as the liner material (again resembling FIG. 3) in accordance with an embodiment of the invention. These nozzles lasted an average of 10.76 hours before a gradual voltage decay determined the end of life. There were signs of some very minor cracking at high magnification that did not appear to have any effect on arc behavior and only some melting was observed. The range of hardware life varied from about 9 hours to 11 hours depending upon the rate of voltage decay which was fairly consistent.

Also listed on Table 1 are conventional nozzles fabricated from Copper only (per FIG. 2). These lasted an average of only 4.08 hours before sever melting resulted in rapid voltage decay. Again no cracking was observed. The range of hardware life varied from around 3 hours to 5 hours and depending entirely on the extent of melting. As can be seen from Table 1, both Tungsten alloy lined nozzles and Molybdenum lined nozzles in accordance with the invention performed better than copper only, with Molybdenum lined nozzles performing having much better performance. Both, however, offer performance that is still below that of Thoriated Tungsten liner nozzle. However, because both lacks the environmental disadvantages of Thoriated Tungsten liner nozzles, they nevertheless represent a significant improvement in the art.

However, the inventors have also discovered that nozzles having a liner resembling that of FIG. 3 can be significantly improved so as to have a performance that is closer to or even better than that a Thoriated Tungsten liner nozzle. By fabricating a nozzle having a liner in accordance with FIG. 8 (which will be described in detail below), one can obtain comparable performance. For example, referring back to Table 1, one can see that if the nozzle is made in accordance with FIG. 8 so as to have a relatively thinner lining of Molybdenum, one can vastly improve the nozzle performance. Accordingly, nozzles with Thin Molybdenum liners were tested in the same fashion and found to last 14.33 hours before a gradual voltage decay determined end of life. In this example there were no signs of cracking and no melting significant enough to affect the performance of the nozzle. The thinner lining configuration was designed in accordance with embodiments of the invention so as to have a ratio between the total thickness of the Molybdenum (dimension C in FIG. 8) and of the Copper (dimension D in FIG. 8) to just the Molybdenum Wall thickness (dimension C in FIG. 8) of 5.28:1 and having a Molybdenum wall thickness C of 1.04 mm. The ratio is this (C+D)/C. The range of hardware life varied from about 13 to 15 hours and depending on the rate of voltage decay.

Thus, to summarize Table 1, using either a Tungsten alloy lining that has a thickness greater than typical plating thicknesses in a plasma nozzle or using a Molybdenum lining in a plasma nozzle advantageously and significantly improves nozzle performance when compared to pure copper nozzles. To improve performance even further, one can optimize the thickness ratio between the nozzle wall and liner thicknesses to be with an optimal range and achieve comparable performance, and thus offer a replacement for Thoriated Tungsten lined nozzles.

With the above information in mind, exemplary embodiments of the nozzle in accordance with the invention will now be described as well as non-limiting ways of making and using the same.

FIG. 1 schematically shows a plasma spray gun that can be used to practice the invention. The plasma gun 1, like a conventional plasma gun, includes a gun body 10 that can accommodate a nozzle 20 and which includes, among other things, cooling passages which circulate cooling fluid entering via an inlet 11 and exiting via an outlet 12. The cooling passages are such that cooling fluid enters spaces 30 surrounding the nozzle 20 and passes (see direction of arrows) from a first annular space arranged on one side of nozzle cooling fins 24 to a second annular space arranged on an opposite side of the cooling fins 24. The cooling fluid is heated by the cooling fins 24 and functions to transfer heat away from the nozzle 20 out through the outlet 12.

The nozzle 20 has a first or cathode receiving end 21 and a second or plasma discharging end 22 having a flange. The cooling fins 24 surround an intimidate portion of the nozzle 20 and function to conduct heat away from an area of the nozzle bore which experiences heating generated by electric arc 40. The arc 40 results when a voltage potential is created between a cathode 50 and an anode 60 whose function is performed by the body 10. The arc 40 can form anywhere in the bore an area referred to as an arc attachment zone 70 (see FIG. 4). Because this zone experiences very significant heating due to the arc 40, the cooling fins 24 are arranged in an area of the nozzle body surrounding this zone. As explained above, the nozzle 20 also can include a lining material 23 which can withstand higher temperatures than the material making up the main portion or body of the nozzle 20. In the example shown in FIG. 1, the material making up the main portion or body of the nozzle 20 is a copper material while the liner or lining material 23 is a Tungsten material.

Figure 4:
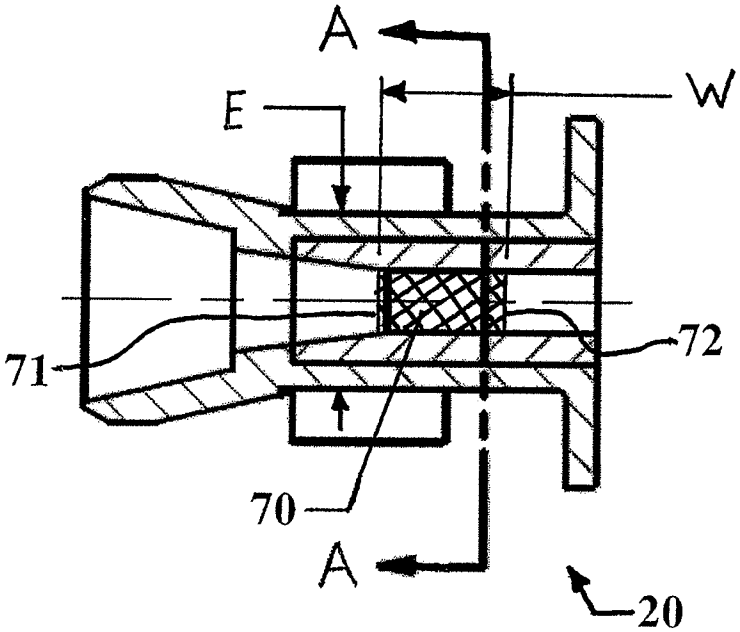
FIG. 4 shows a commercially usable nozzle similar to that of FIG. 3 and illustrating an arc attachment zone which is shown in crisscross sectioning.

With reference to FIGS. 2-4, it can be seen that the nozzle 20 (with the liner removed) defines a lining receiving opening 25 (see FIG. 2) which is generally cylindrical and extends between the discharging end 22 and an annular shoulder 26. The liner 23 typically has an outer cylindrical diameter slightly larger than the opening 25 so that there is an interference fit there-between all the way up to the point where it contacts the annular shoulder 26 (see FIG. 3). During manufacture of the nozzle 20, the main bore 29 and tapered inlet section 28 are machined to the desired specification sizes. As explained above, when the nozzle 20 is used for a significant amount of time during plasma spraying, axial cracks AC and even circumferential cracks leading to lining failure LF can result. These are shown in FIG. 3 for purposes of illustration, and typically occur in the arc attachment zone 70 schematically illustrated in FIG. 4. The zone 70 typically extends from a position 71 located slightly upstream of a diameter transition point 27 (see FIG. 3) to a position 72 located downstream of the point 27. The width of the zone 70 can be defined by the value "W". Although this zone 70 can vary in axial length, and the arc 40 does not contact or move around to every part of the inner surface in the zone 70 equally, it generally has a maximum axial width defined by the positions 71 and 72.

Figure 6:
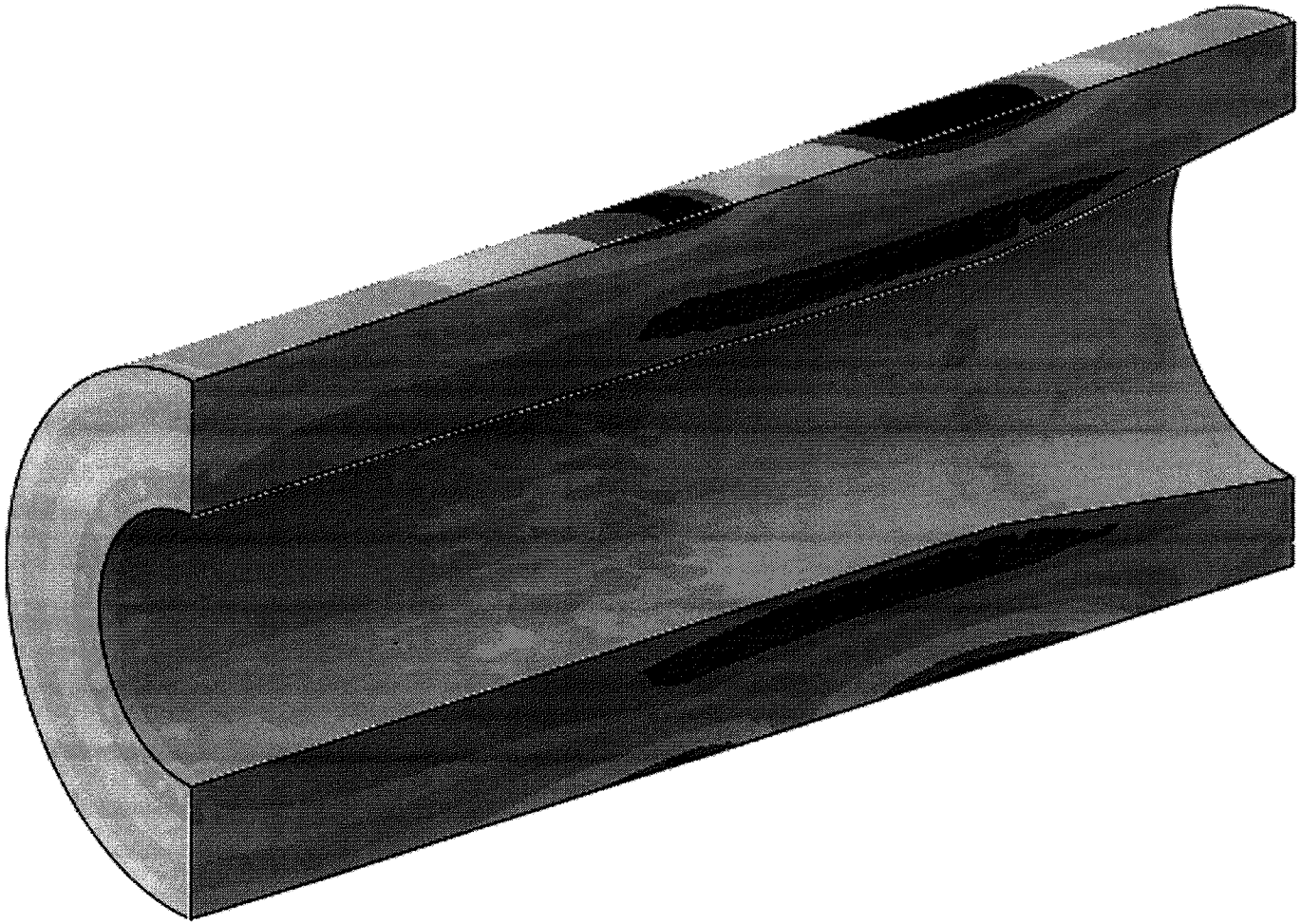
FIG. 6 shows a computer model cross-section of a bore portion of a conventional nozzle lining and illustrates the localized thermal stresses (shown as darker regions) which occur in an area of the arc attachment zone.

With reference to FIG. 6, it can be seen that if the liner 23 is not properly sized to the nozzle 20 (as is the case conventionally), the result is that very significant localized thermal stresses can be created in the liner material, and are especially located in the arc attachment zone. This is evident in the computer model shown in FIG. 6 which shows the areas of highest thermal stresses in dark shading being located in the arc attachment zone portion of the liner material. Embodiments of the invention aim to avoid the kind of stresses evident in FIG. 6, but takes into consideration the information provided therein. Moreover, when one compares the example of FIG. 6 with that of FIG. 3, one can appreciate that the stress concentrations that occur within an incorrectly designed Tungsten lined plasma nozzle, can lead to internal cracking as observed in FIG. 3. As is apparent, the cracking shown in FIG. 3 occurs in the very area of FIG. 6 which shows the highest stress, i.e., within the area known as the arc attachment zone 70.

Figure 7:
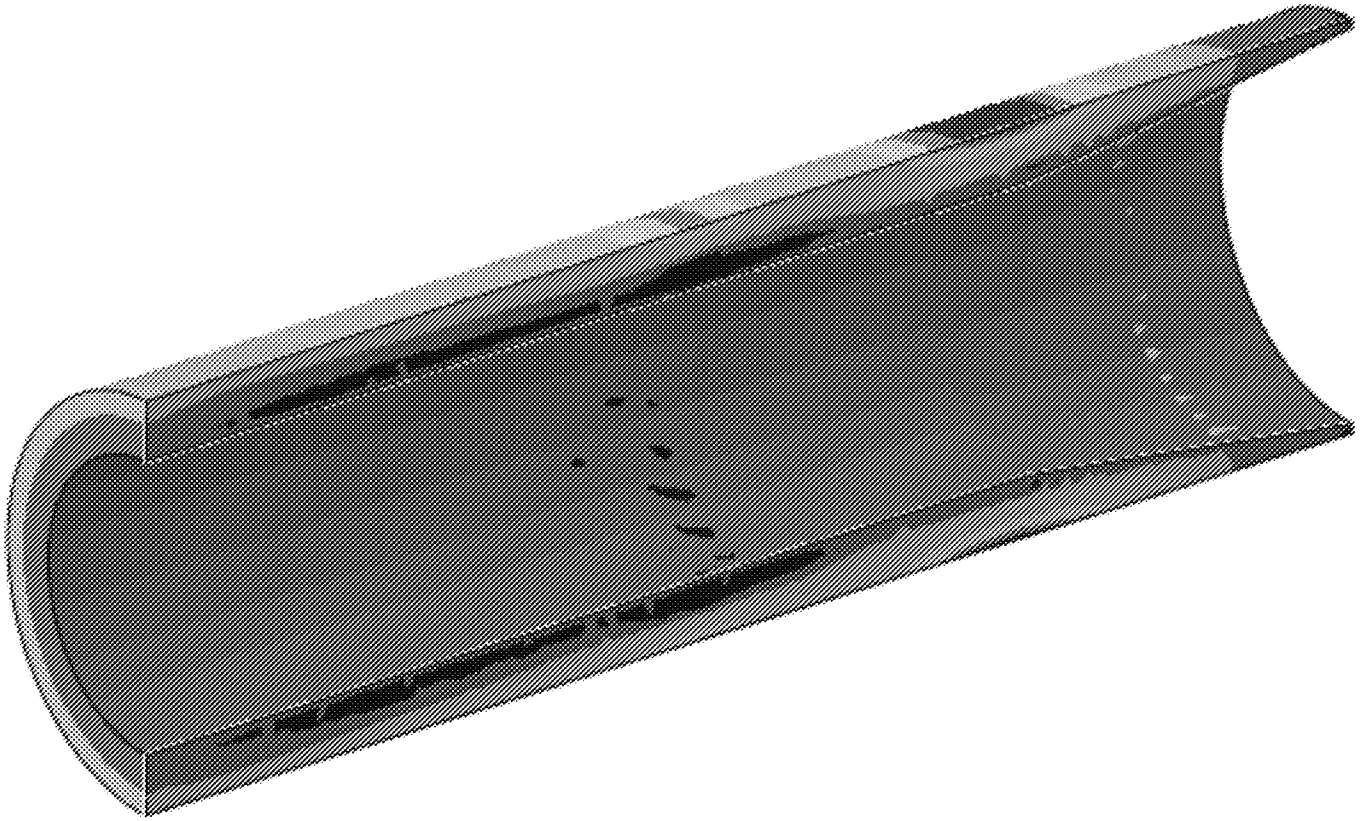
FIG. 7 shows a computer model cross-section of a bore portion of a nozzle lining in accordance with an embodiment of the invention and shows an absence of localized thermal stresses in an area of the arc attachment zone in contrast to FIG. 6.

With reference to FIG. 7, it can be seen that if the liner 23 is properly sized to the characteristics of the nozzle 20 (as is the aim of the invention), the result is that very significant localized thermal stresses are no longer created in the liner material, and especially are not concentrated in the arc attachment zone 70. This is evident in the computer model shown in FIG. 7 which (in contrast to FIG. 6) no longer shows areas of highest thermal stresses being located in the arc attachment zone of the liner material. Instead, the computer model shows an absence of localized thermal stresses in an area of the arc attachment zone. In particular, unlike FIG. 6, the thermal stresses resulting from the invention are less localized, are more attenuated, do not occur to greater extent in the arc attaching zone, are very significantly reduced in the arc attachment zone, and are more even distributed throughout the downstream length of the nozzle bore.

Figure 8:
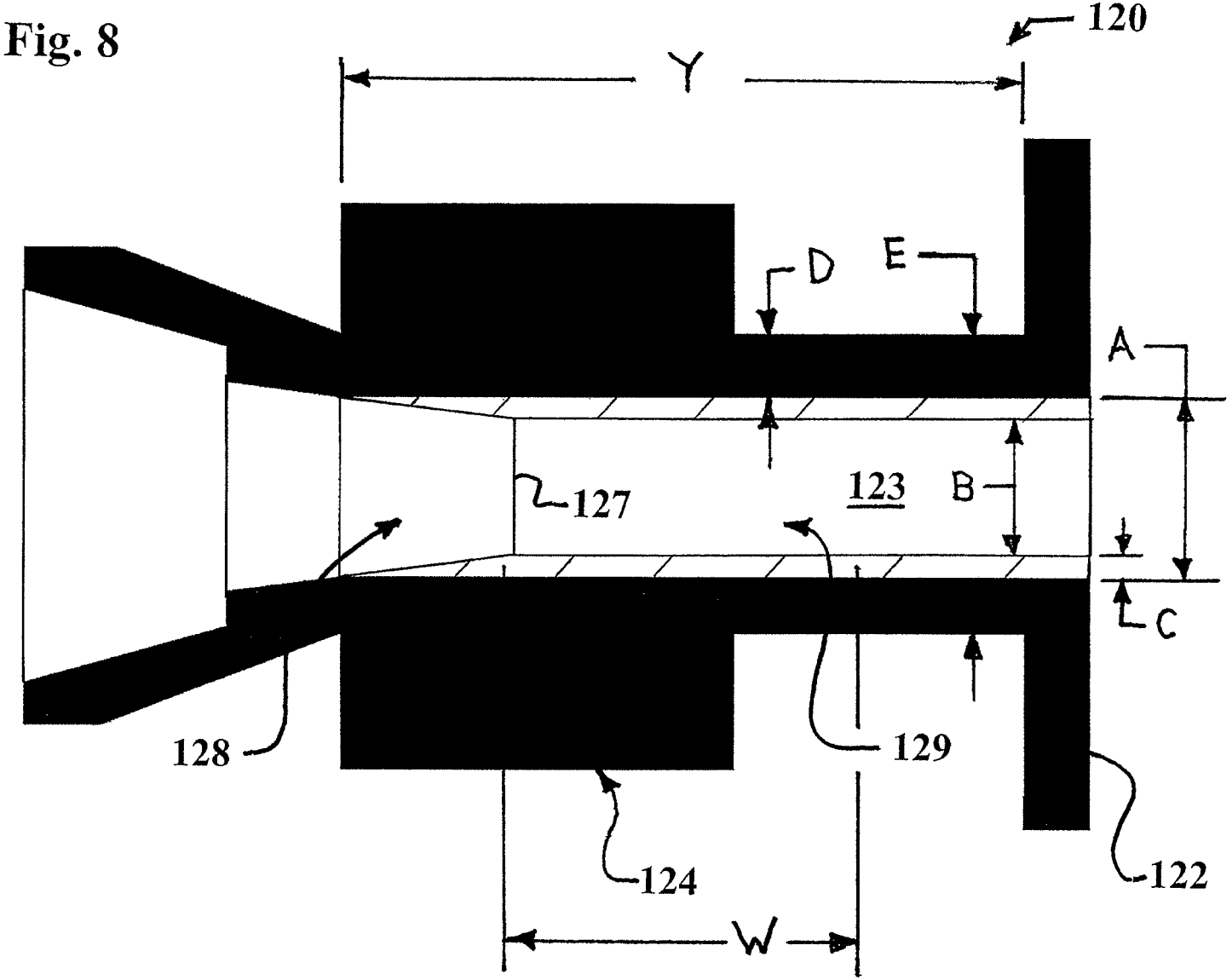
FIG. 8 shows another non-limiting embodiment of a nozzle in accordance with the invention.

With reference to FIG. 8, it can be seen how a nozzle body of the type shown in FIGS. 2 and 3 can be designed to include a liner in accordance with the invention with the aim of achieving the stress profile shown in FIG. 7. In this embodiment, the nozzle 120 is manufactured with a liner material sleeve 123 in such a way as to eliminate or significantly reduce the localized thermal stresses associated with conventional nozzles, and especially so in an area of the arc attachment zone. This can be accomplished in a number of ways as will be described herein. In the embodiment of FIG. 8, this is accomplished by manufacturing the nozzle 120 so that the liner sleeve 123 has an outer cylindrical diameter "A", an inside cylindrical diameter "B" (which also defines the central bore of the nozzle 120), and a wall thickness "C". Furthermore, the wall thickness "C" is sized in relation to one or more characteristics of the main body portion of the nozzle 120. These characteristics include, among other things, the wall thickness "D" and/or the overall diameter "E" of the body of the nozzle 120. The diameter "E" can typically extend across axial width "Y" in FIG. 8. Additional characteristics include tailoring the thermal conductivity (which is a function of the wall thickness "C") of the liner 123 to that of the portion of the body surrounding the liner, i.e., to the wall thickness "D". This is especially the case in an area of the fins 124 and a portion of the body arranged immediately downstream of the fins 124 and which has a surface that can be placed in contact with the cooling fluid, i.e., the wall thickness "D" within axial width of the arc attachment zone. The axial length "Y" of the portion of the body of the nozzle 120 to which one tailors the wall thickness "C" of the liner 123 can extend from an upstream end of the fins 124 up to as far as the flange located at the downstream end 122 as shown in FIG. 8. However, value "C" is measured from point 127 to end 122 in FIG. 8, and is of most concern within an area defined by the axial width of the arc attachment zone.

In the non-limiting embodiment of FIG. 8, the wall thickness "D" should be of greater thickness than the wall thickness "C". A ratio of the wall thickness "D" to that of wall thickness "C" starting from an axial location corresponding the transition 127 and extending toward end 122 by an amount that is a fraction of the length "Y" should be a focus of concern. However, as noted above, the main focus should be the values arranged within an axial length shorter than "Y" such as that containing the arc attachment zone (see ref. 70 in FIG. 4). One should, for example, at least specifically take into account the values "C", "D" and "E" within the axial length "W" defined by the arc attachment zone (see also FIG. 4). By way of non-limiting examples, with the body of the nozzle 120 being made of a copper material and the liner 123 being made of a Tungsten material, these values can those specified in the table below.

According to one non-limiting example, a plasma gun nozzle of the type shown in FIG. 1 can be configured to utilize a nozzle 120 comparable to that of FIG. 8 and that utilizes a Tungsten alloy lining or liner 123 whose wall thickness "C" is approximately 1.04 mm and which utilizes a ratio of total thickness (C+D) to Tungsten alloy lining wall thickness C of about 5.28. Using such values, the nozzle 120 can be made operated with the stress profile closer to that of FIG. 7 while avoiding the stress concentrations shown in FIG. 6. Like that of FIG. 4, the liner 123 can include an upstream tapered portion 128 that generally matches the tapered upstream portion of the nozzle body and extends to transition 127 as shown in FIG. 8. The liner 123 can also include the main bore portion 129 that extends from the transition 127 to the end 122 of the nozzle 120.

Figure 10:
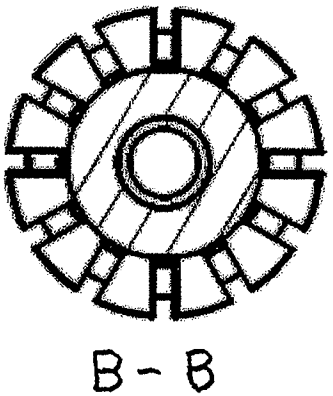
FIG. 10 shows a cross-section view of Section B-B in FIG. 9.
Figure 9:
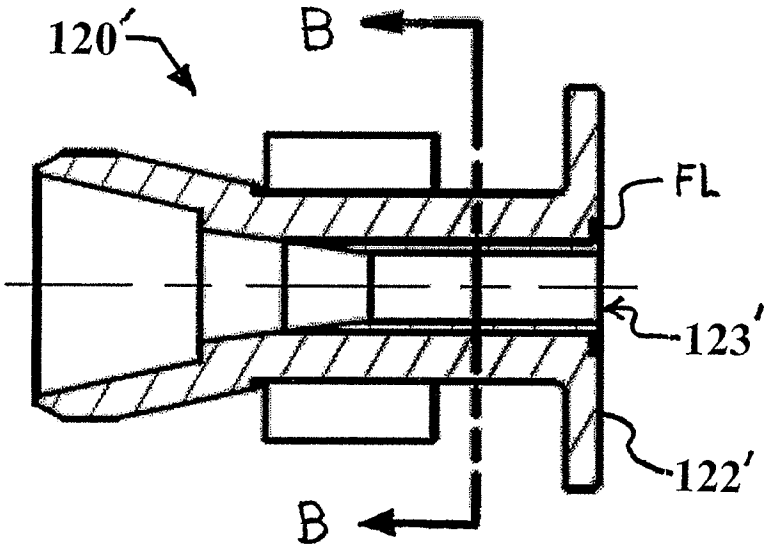
FIG. 9 shows still another non-limiting embodiment of a nozzle in accordance with the invention.

With reference to FIGS. 9 and 10, it can be seen how the invention can be implemented on a commercially usable nozzle 120'. In this embodiment, the liner 123' is sized and configured to the body of the nozzle 120' as disclosed herein and further includes a flange FL which can be seated in a comparably sized counterbore formed in end 122'. In this example, the nozzle 120' is similarly configured and sized to utilize a liner material sleeve 123' in such a way as to eliminate or significantly reduce the localized thermal stresses associated with conventional nozzles, and especially so in the arc attachment zone. The resulting thermal stress profile should be closer to that shown in FIG. 7 as opposed to that of FIG. 6.

Example 1—Tungsten Alloy Lining with Non-Optimized Lining Thickness

In accordance with another non-limiting example of the invention, there is provided a plasma gun nozzle of any of the type shown in FIG. 4 having a Tungsten alloy lining wall conforming to the following requirements. The wall thickness "C" should not be made so thin that the Tungsten alloy liner will cease protecting the copper to the point where melting of the underlying copper occurs. On the other hand, the wall thickness "C" cannot be made too thick as it will allow stress concentrations to quickly build and result in potential catastrophic failure of the Tungsten alloy liner. With this in mind, one can use an existing copper nozzle body in combination with a Tungsten alloy liner having a generally cylindrical wall thickness "C" of between about 2.0 mm and about 5.0 mm, and preferably between about 2.5 mm and about 4.0 mm, and most preferably about 2.95 mm. In embodiments, the Tungsten is alloyed with iron and nickel such as CMW 3970 which has the following weight percent composition 97W; 2.1Ni; 0.9Fe. In embodiments, each element in the Tungsten alloy should have purity in the range of about 99% to 100%, and preferably between about 99.5% and about 100%, and most preferably between about 99.95% and about 100%.

Example 2—Tungsten Alloy Lining with Optimized Lining Thickness

In accordance with another non-limiting example of the invention, there is provided a plasma gun nozzle of any of the types shown in FIG. 8 having a thin Tungsten alloy lining wall conforming to the following requirements. The wall thickness "C" should not be made so thin that the Tungsten alloy liner will cease protecting the copper to the point where melting of the underlying copper occurs. On the other hand, the wall thickness "C" cannot be made too thick as it will allow stress concentrations to quickly build and result in potential catastrophic failure of the Tungsten alloy liner. With this in mind, one can use an existing copper nozzle body in combination with a Tungsten alloy liner having a generally cylindrical wall thickness "C" of between about 0.25 mm and about 1.25 mm, and preferably between about 0.5 mm and about 1.0 mm, and most preferably between about 0.75 mm and about 1.0 mm. In embodiments, the Tungsten is alloyed with iron and nickel such as CMW 3970 which has the following weight percent composition 97W; 2.1Ni; 0.9Fe. In embodiments, each element in the Tungsten alloy should have purity in the range of about 99% to 100%, and preferably between about 99.5% and about 100%, and most preferably between about 99.95% and about 100%.

Example 3—Molybdenum Lining with Non-Optimized Lining Thickness

In accordance with another non-limiting example of the invention, there is provided a plasma gun nozzle of any of the type shown in FIG. 4 having a Molybdenum alloy lining wall conforming to the following requirements. The wall thickness "C" should not be made so thin that the Molybdenum liner will cease protecting the copper to the point where melting of the underlying copper occurs. On the other hand, the wall thickness "C" cannot be made too thick as it will allow stress concentrations to quickly build and result in potential catastrophic failure of the Molybdenum liner. With this in mind, one can use an existing copper nozzle body in combination with a Molybdenum liner having a generally cylindrical wall thickness "C" of between 2.0 mm and about 5.0 mm, and preferably between about 2.5 mm and about 4.0 mm, and most preferably about 2.95 mm. In embodiments, the Molybdenum should have purity in the range of about 99% to 100%, and preferably between about 99.5% and about 100%, and most preferably between about 99.95% and about 100%.

Example 4—Molybdenum Lining with Optimized Lining Thickness

In accordance with another non-limiting example of the invention, there is provided a plasma gun nozzle of any of the types shown in FIG. 8 having a thin Molybdenum lining wall conforming to the following requirements. The wall thickness "C" should not be made so thin that the thin Molybdenum liner will cease protecting the copper to the point where melting of the underlying copper occurs. On the other hand, the wall thickness "C" cannot be made too thick as it will allow stress concentrations to quickly build and result in potential catastrophic failure of the Molybdenum liner. With this in mind, one can use an existing copper nozzle body in combination with a Molybdenum liner having a generally cylindrical wall thickness "C" of between about 0.25 mm and about 1.25 mm, and preferably between about 0.5 mm and about 1.0 mm, and most preferably between about 0.75 mm and about 1.0 mm. In embodiments, the Molybdenum should have purity in the range of about 99% to 100%, and preferably between about 99.5% and about 100%, and most preferably between about 99.95% and about 100%.

In accordance with still another non-limiting example of the invention, there is provided a plasma rocket nozzle having either a Tungsten alloy, a Molybdenum, or a thin Molybdenum lining wall conforming to requirements comparable to those noted above.

In cases where the preferred ratio between the total wall thickness of Copper and Tungsten alloy or Molybdenum (C+D/C) and the preferred wall thickness of Tungsten alloy or Molybdenum cannot both be met simultaneously, then the total ratio should be given preference.

Although the various embodiments of the nozzle disclosed herein can be manufactured in a variety of ways, one can, by way of non-limiting example, make the same by first placing a solid Tungsten alloy or Molybdenum rod into a casting mold and casting a copper material sleeve around the rod. Once removed from the casting mold, the cast assembly can be machined so as to form both the outside profile and the inside profile shown in, e.g., FIGS. 8-10. The inside profile specifically includes machining sections 128 and 129 of the liner shown in FIG. 8. During the machining, reference to the specifications shown in the above-noted table should be taken and/or to the criteria for disclosed herein for tailoring the various values A-E described herein. Most of the machining can take place via a CNC lathe with the fins 124 being formed on a CNC milling machine.

Other materials may offer some improvement in this regard. Such materials should preferably have the following properties. They should be more ductile and fracture tolerant than Tungsten especially under high thermal loading and high temperature gradients. They should also have a high melting point similar or close to that of Tungsten. And when lower, they should have a high enough thermal conductivity to compensate for having a lower melting point than Tungsten. Potential materials include pure metals such as Silver, Iridium as they have many of the above-noted desired properties. Although, as noted above, Silver and Iridium are arguably currently too expensive for practical use. Preferred materials include Tungsten alloy and Molybdenum as described above. Other Tungsten alloys include those with higher amounts of Nickel and Copper, but with lower melting points and thermal conductivity, but higher ductility as well as those with lower amounts of Nickel and Copper, but with higher melting points and thermal conductivity, but lower ductility. Other materials that can be alloyed with Tungsten include Osmium, Rhodium, Cobalt and Chromium. These metals possess a high-enough melting point and high thermal conductivity such that they can be alloyed with Tungsten and utilized in a nozzle liner material. Commercial grade Molybdenum and a Tungsten alloy having 2.1% Nickel and 0.9% Iron have both been tested and used in nozzle liners by Applicant, and have been compared to a Copper only nozzle and to offer significant improved performance.

The instant application expressly incorporates by reference herein in their entireties International Application No. PCT/US2013/076610 filed on Dec. 19, 2013 entitled LONG-LIFE NOZZLE FOR A THERMAL SPRAY GUN AND METHOD MAKING AND USING THE SAME claiming the priority benefit of U.S. provisional application No. 61/759,086 filed on Jan. 31, 2013, and International Application No. PCT/US2013/076603 filed on Dec. 19, 2013 entitled OPTIMIZED THERMAL NOZZLE AND METHOD OF USING SAME claiming the priority benefit of U.S. Provisional Application No. 61/759,071 filed Jan. 31, 2013.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and sprit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A thermal spray gun comprising:
- a cathode generating an arc;
- a nozzle body having a rear end that surrounds a front portion of the cathode;
- a liner material arranged within the nozzle body and having an inside surface with an arc attachment zone;
- a material of the nozzle body having a lower melting temperature than that of the liner material;
- an internal coolant receiving space surrounding a portion of the nozzle body;
- a total wall thickness of a portion of the nozzle body and the liner material measured at an imaginary plane passing through the coolant receiving space and the arc attachment zone to that of a wall thickness of the liner material measured at the imaginary plane defining a ratio,
- wherein the liner material is made of one of:
  - a Tungsten alloy other than lanthanated Tungsten and having a cross-section thickness greater than 0.25 mm;
  - Molybdenum;
  - Silver; or
  - Iridium,
- wherein the thermal spray gun is structured and arranged to apply a coating, and
- wherein the ratio is at least one of:
  - between about 3.5:1 and about 7:1;
  - between about 4.1:1 and about 6:1; or
  - about 5:1, and
- wherein the ratio results in a reduction of thermal stresses and a reduced potential for cracking in the arc attachment zone.

2. The thermal spray gun of claim 1, wherein the ratio is between about 3.5:1 and about 7:1.

3. The thermal spray gun of claim 1, wherein the liner material is Tungsten alloy other than lanthanated Tungsten and the wall thickness of the liner material is between 0.25 mm and 1.25 mm.

4. The thermal spray gun of claim 1, wherein the liner material is Molybdenum and the wall thickness of the liner material is between 2 mm and 5 mm.

5. The thermal spray gun of claim 1, wherein the liner material is Silver.

6. The thermal spray gun of claim 1, wherein the liner material is Iridium.

7. The thermal spray gun of claim 1, wherein the nozzle body is made of a copper material.

8. The thermal spray gun of claim 1, wherein, in normal operation, the liner material experiences less or comparable thermal stress in an area of the arc attachment zone than in an area downstream of the arc attachment zone.

9. The thermal spray gun of claim 1, wherein the wall thickness of the liner material is at least one of:
- between about 0.25 mm and about 1.25 mm;
- between about 0.50 mm and about 1.0 mm; or
- between about 0.75 mm and about 1.0 mm.

10. The thermal spray gun of claim 1, further comprising a cathode and an anode body through which cooling fluid circulates.

11. The nozzle of claim 1, wherein the cathode is centrally disposed, extends into a tapered upstream end of the nozzle body and is axially spaced from the arc attachment zone.

12. A plasma coating nozzle for a thermal spray gun and having improved operating life comprising:
- a cathode generating an arc;
- a coating nozzle body having a rear end that surrounds a front portion of the cathode;
- a liner material arranged within the nozzle body and comprising an inside surface having an arc attachment zone;
- an internal liquid coolant receiving space surrounding a portion of the nozzle body and a portion of the arc attachment zone;
- a material of the nozzle body having a lower melting temperature than that of the liner material; and
- a total wall thickness, measured in a cross-sectional area of the arc attachment zone, of a portion of the nozzle body and a portion of the liner material to that of a wall thickness of the liner material defining a ratio,
- wherein the liner material is made of one of;
  - a Tungsten alloy other than lanthanated Tungsten and having a cross-section thickness greater than 0.5 mm;
  - Molybdenum;
  - Silver; or
  - Iridium,
- wherein the ratio is at least one of:
  - between about 3.5:1 and about 7:1;
  - between about 4.1:1 and about 6:1; or
  - about 5:1, and wherein the ratio results in a reduction of thermal stresses and a reduced potential for cracking in the arc attachment zone thereby improving the operating life of the nozzle.

13. The nozzle of claim 12, wherein the ratio is between about 3.5:1 and about 7:1.

14. The nozzle of claim 12, wherein the plasma coating nozzle is a replaceable nozzle.

15. The nozzle of claim 12, wherein the liner material is a Tungsten alloy other than lanthanated Tungsten.

16. The nozzle of claim 12, wherein the liner material is Molybdenum.

17. The nozzle of claim 12, wherein the liner material is Silver.

18. The nozzle of claim 12, wherein the liner material is Iridium.

19. The nozzle of claim 12, wherein the nozzle body is made of a copper material.

20. The nozzle of claim 12, wherein the wall thickness of the liner material is at least one of:

between about 0.5 mm and about 1.25 mm;

between about 0.50 mm and about 1.0 mm; or between about 0.75 mm and about 1.0 mm.

21. The nozzle of claim 12, wherein a first portion of the liner material has an internal tapered section and a main portion of the liner material is generally cylindrical.

22. The nozzle of claim 12, wherein the cathode is centrally disposed, extends into a tapered upstream end of the nozzle body and is axially spaced from the arc attachment zone.

23. A method of making the nozzle of claim 12, comprising:

forming the liner material with a wall thickness whose value takes into account at least one of:

a wall thickness of a portion of the nozzle body; or a ratio of a total wall thickness of a portion of the nozzle to that of a wall thickness of a portion of the liner material.

24. A method of coating a substrate using a thermal spray gun, comprising:

installing the nozzle of claim 12 on a thermal spray gun; and plasma spraying a coating material onto a substrate utilizing the thermal spray gun.

25. A thermal spray gun structured and arranged to apply a coating, comprising:

a cathode generating an arc;

a nozzle body having a rear end that surrounds a front portion of the cathode;

a liner sleeve arranged within the nozzle body and comprising an inner cylindrical surface having an arc attachment zone;

said arc attachment zone being axially spaced from an exit end of the nozzle body and having a portion that is surrounded by an internal liquid coolant receiving space; and a material of the nozzle body having a lower melting temperature than that of the liner sleeve, wherein, in a cross-section through the portion of the arc attachment zone, a wall thickness of the liner sleeve is defined by variable C and a wall thickness of a portion of the nozzle body surrounding the portion of the arc attachment zone is defined by variable D, wherein one of:

a ratio of (C+D)/C is about 5.28 and the liner sleeve comprises Tungsten alloy other than lanthanated Tungsten; or a ratio of (C+D)/C is about 5.28 and the liner sleeve comprises Molybdenum, and wherein the ratio results in a reduction of thermal stresses and a reduced potential for cracking in the arc attachment zone.

26. The nozzle of claim 25, wherein the cathode is centrally disposed, extends into an upstream end of the nozzle body and is axially spaced from the arc attachment zone.

* * * * *